US006763198B2

(12) United States Patent
Matsumoto

(10) Patent No.: US 6,763,198 B2
(45) Date of Patent: Jul. 13, 2004

(54) METHOD FOR DETERMINING THE STATUS OF ATTACHMENT OR DETACHMENT OF DEVELOPER CONTAINER, AND IMAGE FORMING APPARATUS

(75) Inventor: Yasuhiro Matsumoto, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/851,936

(22) Filed: May 10, 2001

(65) Prior Publication Data

US 2001/0051051 A1 Dec. 13, 2001

(30) Foreign Application Priority Data

May 15, 2000 (JP) ..... 2000-141100

(51) Int. Cl.[7] ..... G03G 15/00
(52) U.S. Cl. ..... 399/13
(58) Field of Search ..... 399/12, 13, 27, 399/29, 30, 62, 63

(56) References Cited

U.S. PATENT DOCUMENTS 5,398,106 A * 3/1995 Eguchi ..... 399/13 X
5,784,665 A * 7/1998 Bae ..... 399/13
5,893,007 A * 4/1999 Lim ..... 399/13
6,148,156 A 11/2000 Matsumoto ..... 399/30

FOREIGN PATENT DOCUMENTS

| | | | |
|---|---|---|---|
| JP | 61-99176 | | 5/1986 |
| JP | 04-188172 | * | 7/1992 |
| JP | 8-95363 | | 4/1996 |
| JP | 9-81015 | | 3/1997 |

* cited by examiner

*Primary Examiner*—Sandra Brase
(74) *Attorney, Agent, or Firm*—Fitzpatrick, Cella, Harper & Scinto

(57) ABSTRACT

A method for determining whether a developer container for containing developer is attached to an image forming apparatus includes the steps of detecting information pertaining to a magnetic permeability of the developer in the developer container; and determining whether the developer container is attached to the image forming apparatus in accordance with outputs obtained in the detecting step. With the adoption of the foregoing method, there is no need for separately providing any sensor or the like, which is dedicated to determining whether the developer container is attached to the image forming apparatus. As a result, it is possible to reduce the cost of making the image forming apparatus and to reduce the size of the image forming apparatus.

15 Claims, 8 Drawing Sheets

AT MAXIMUM FILLING UP
AGITATION CYCLE
dva
Vmax

AT NEAR POSITION OF SENSOR INSTALLATION
AGITATION CYCLE
dvb

AT EMPTY
AGITATION CYCLE
dvc
Vmin

WITHOUT CARTRIDGE
Vmin
SENSOR OUTPUT
TIME

METHOD FOR DETERMINING THE STATUS OF ATTACHMENT OR DETACHMENT OF DEVELOPER CONTAINER, AND IMAGE FORMING APPARATUS

BACKGROUND OF THE INVENTION

1. Field of the Invention

The present invention relates to an image forming apparatus using an electrophotographic type of an electrostatic recording method. More particularly, the invention relates to an image forming apparatus, such as a copying machine, a printer, a multifunctional printer, or a facsimile apparatus, among others, and also, relates to a method for determining the status of attachment or detachment of the developer container which is detachably attachable to the image forming apparatus.

2. Related Background Art

For the image forming apparatus which adopts an electrophotographic method or the like, there has been known conventionally an image forming apparatus provided with a device for detecting residual developer to detect the remaining amount of toner in the developer container which stores developer (toner) as one example of the device for determining the status of a developer container.

For a device of the kind for determining the remaining amount of developer, there have been proposed various methods put in practice, such as the optical method that uses light emitting and photosensitive devices, the method that uses electrostatic capacitance method for detecting the electrostatic capacitance of developer, the piezoelectric method that detects the pressure of developer by means of vibration, and the method that uses a magnetic permeability sensor (toner sensor) for detecting the changes of magnetic permeability as voltage changes by the utilization of magnetism of developer, among others.

Also, for an image forming apparatus of the foregoing kind, there has been put in practice the image forming apparatus of cartridge type that the cartridge, which contains at least a developer container, is made detachably attachable to the main body fo the image forming apparatus, and the cartridge is replaced with a new cartridge when the developer in the developer container becomes less than a designated amount.

For a cartridge type of the foregoing kind, it is preferable to use repeatedly a residual developer sensor which serves as detecting means when cartridges are replaced.

Also, as an error indication to the user, there has been proposed a method for indicating the event that the developer (toner) in the developer container no longer exists (becomes less than a designated amount) or that the cartridge itself has not been inserted as yet (in a state of being detached) so as to enable the user to take adequate actions with ease accordingly. In this case, besides detecting means for detecting the presence or absence of toner in an amount more than a designated amount in the developer container of a cartridge, there is provided detecting means that uses a microswitch, a photosensor, or the like in order to detect the status of attachment of the cartridge (developer container) or detachment thereof.

Also, among those provided with detecting means to detect the status of attachment of a cartridge or detachment thereof, some of image forming apparatuses may cause the main body thereof to be damaged and put it out of order or the like if the image forming apparatus is allowed to execute a specific operation, while the cartridge is in a status of being detached. Here, therefore, the image forming apparatus of cartridge type should be arranged to be able to prohibit the operation thereof if the cartridge is found to be detached by the detection of the status of attachment or detachment of the cartridge. Thus, it is a prerequisite to detect and ascertain the status of attachment or detachment of a cartridge.

However, for the conventional image forming apparatus described above, a sensor dedicated to detecting the status of attachment or detachment of a cartridge is separately needed in addition to the sensor for detecting residual developer. This inevitably presents a problem of higher costs.

Also, if a photosensor, a microswitch. or the like should be used for detecting the status of attachment or detachment of a cartridge, there is a need for securing a space of the installation of such sensor or switch inside an image forming apparatus. In some cases, therefore, this arrangement may stand in the way of making the apparatus smaller.

Furthermore, in order to operate such sensor or switch, several numbers of components are additionally required or the configuration of a related component should be designed in a restricted manner. This may also hinder the implementation of lowering costs or making the apparatus smaller in some cases.

SUMMARY OF THE INVENTION

It is an object of the present invention to provide a method for determining whether a developer container is attached to an image forming apparatus by using detecting means for outputting information corresponding to a magnetic permeability of developer so as to detect a remaining quantity of developer in said developer container, said developer container having an agitating member provided with a magnetic member for agitating developer in said developer container, for agitating developer contained and being detachably attachable to the image forming apparatus without any separate provision of a sensor or the like dedicated to determining the status of the developer container attached to or detached from the main body of the image forming apparatus, while implementing to reduce the costs of the image forming apparatus, as well as to make the image forming apparatus smaller, and also, to provide such image forming apparatus. In other words, it is an object of the invention to provide a method for determining whether a developer container is attached to the main body of an image forming apparatus by use of detecting means for detecting information of the magnetic permeability of the developer in the developer container, and also, to provide such image forming apparatus.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, in conjunction with the accompanying drawings, a description will be made of one embodiment in accordance with the present invention.

For the present embodiment, a description will be made of one example in which the invention is applied to a facsimile apparatus as the image forming apparatus of the present invention. Here, a description will be made in the following order:

(1) The entire structure of a facsimile apparatus.

(2) The structure of the original document reading portion of the facsimile apparatus.

(3) The structure of the image forming portion of the facsimile apparatus.

(4) The structure of the process cartridge detachably attachable to the facsimile apparatus, which holds a developer container.

(5) The structure of a device of the present invention for determining the status of the developer container.

(1) The Entire Structure of a Facsimile Apparatus

Figure 1:
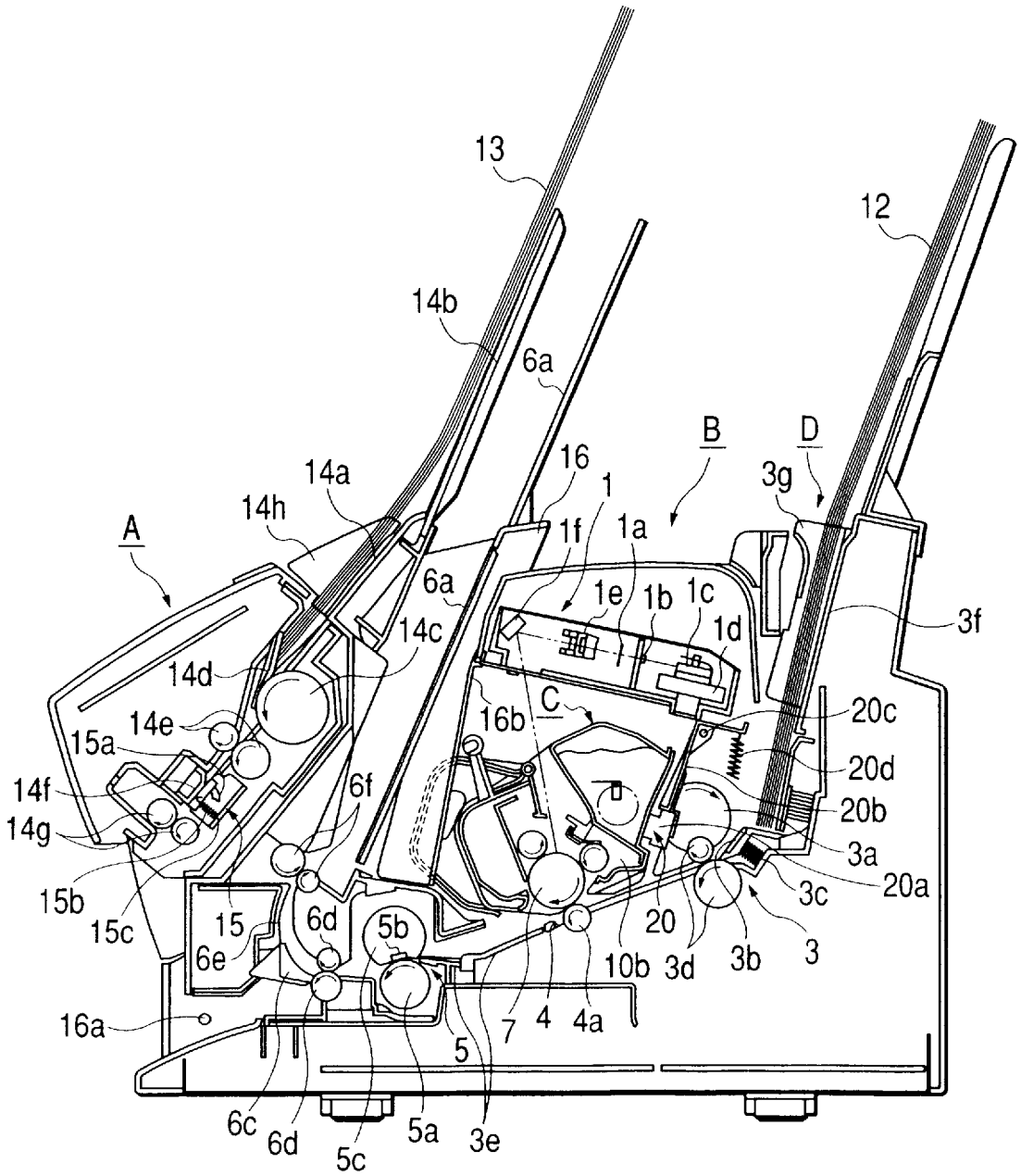
FIG. 1 is a cross-sectional view which shows schematically the structure of an image forming apparatus in accordance with one embodiment of the present invention.
Figure 2:
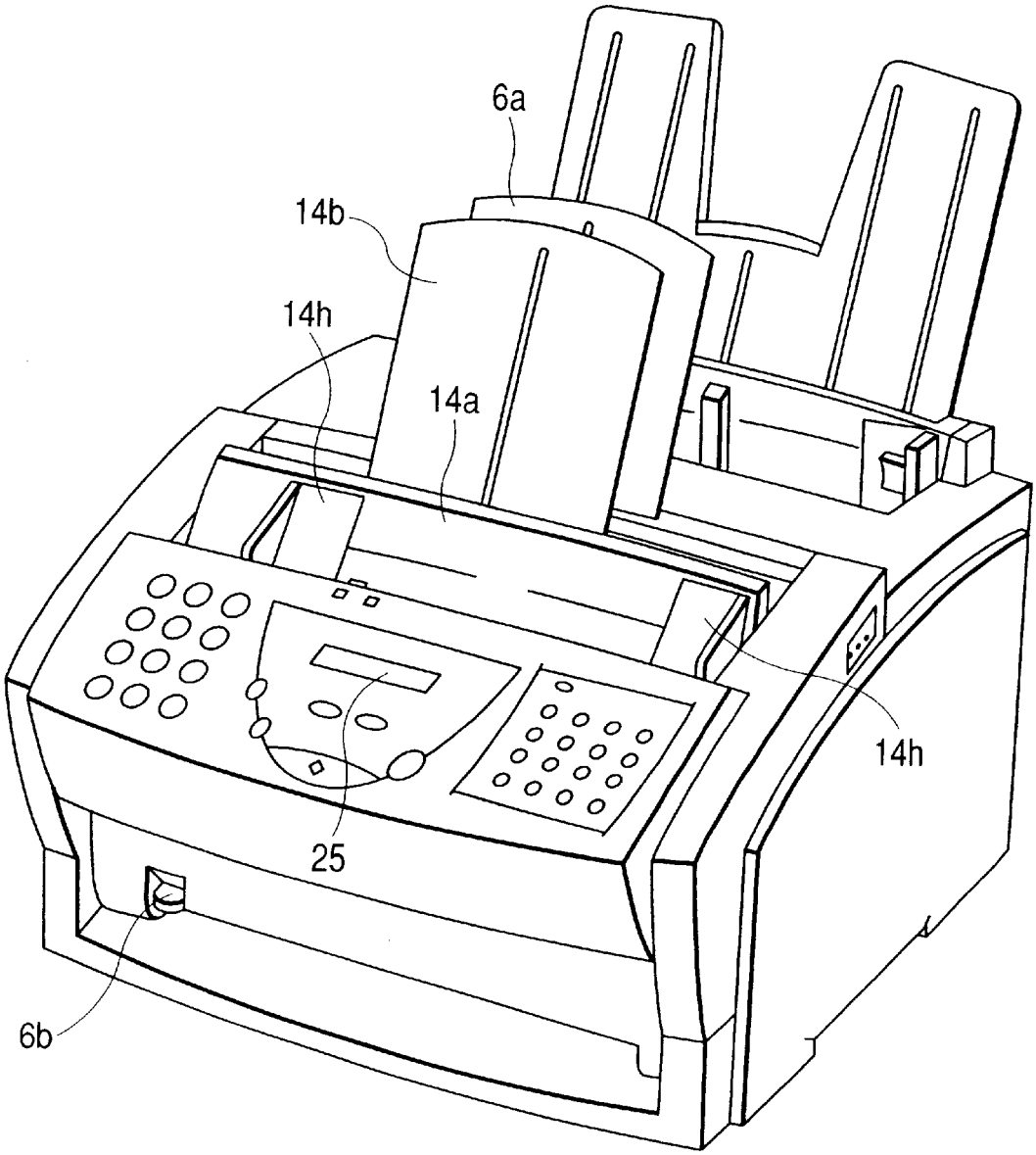
FIG. 2 is a perspective view which shows the outer appearance of the image forming apparatus represented in FIG. 1.

FIG. 1 is a view which shows the structure of a facsimile apparatus provided with an image forming portion B in accordance with the present invention. FIG. 2 is a view which shows the outer appearance thereof.

As shown in FIG. 1, this facsimile apparatus is provided with the original document reading portion A on the front side of the apparatus (upper left side in FIG. 1). Then, the image forming portion B is arranged on the lower deep side thereof (lower right side in FIG. 1). Thus, information read on the original document reading portion A is transmitted to another facsimile apparatus in the facsimile mode or recorded by the image forming portion B of its own in the copy mode.

As shown in FIG. 1, the aforesaid image forming portion B forms latent image on a photosensitive drum 7, which serves as an image bearer, by the irradiation of optical image from the optical system 1 in accordance with the image information. Such latent image is visualized as the toner image by use of developer. Then, in synchronism with the formation of the toner image, a recording sheet 2 serving as a recording medium is conveyed by conveying means 3, and also, the toner image, which is formed on the photosensitive drum 7 on the image forming portion arranged to be a cartridge as the process cartridge C, is transferred by transferring means 4 to the recording sheet 2. The recording sheet 2, which has received the toner image thus transferred, is conveyed to fixing means 5 for the fixation treatment of the toner image, thus being discharged to a tray 6 or outside the apparatus.

(2) The Structure of the Original Document Reading Portion of the Facsimile Apparatus The original document reading portion A reads information on a original document, while carrying the original document 13. As shown in FIG. 1, the original documents 13 stacked on a original document stacking stand 14*a* or an auxiliary stacking stand 14*b* is separated one by one by use of a separation piece 14*d* which is pressurized to be in contact with a separation roller 14*c*, and the original document 13 thus separated is conveyed by use of a conveying roller pair 14*e*. The original document 13 is pressed by pressure means 14*f* to the contact sensor (not shown) of reading means 15. After information on the original document 13 is read while being in contact, the original document 13 is discharged by a discharging roller pair 14*g* to the outside of the original document reading portion A.

The aforesaid reading means 15 reads information by irradiating light from an LED 15*a* serving as the light source to the surface of a original document 13 having information written thereon, and by focusing the reflective light thereof on a photoelectric transfer device 15*c* through a short focus lens 15*b*. The image signals thereof are transmitted to another apparatus though controlling means to be described later in a case of facsimile mode or to the image forming portion B of its own in a case of copy mode.

In this respect, a slider 14*h* is provided for the original document stacking stand 14*a*, which is slidable in the direction at right angles (in the widthwise direction of the original document 13) to the conveying direction of the original document 13. Then, both sides of the original document 13 stacked on the original document stacking stand 14*a* can be aligned by sliding the slider 14*h* to be in agreement with the width of the original document 13.

(3) The Structure of the Image Forming Portion of the Facsimile Apparatus

Now, each structural section of the image forming portion B that forms an image in accordance with recording signals will be described in the order of (an optical system), (recording sheet conveying means), (transferring means), (fixing means), (discharging means), and (process cartridge attaching means).

(Optical System)

The optical system 1 irradiates a light image to a sensitive drum 7 with the light irradiation based on the image information which has been read from an external device or the like. As shown in FIG. 1, a laser diode 1*b*, a polygonal mirror 1*c*, a scanner motor 1*d*, a focus lens 1*e*, and a reflective mirror if are housed in an optical unit 1*a*.

Then, if image signals are provided from another facsimile apparatus, for example, the laser diode 1*b* emits light in accordance with such image signals, and irradiates the image light on the polygonal mirror 1*c*. The polygonal mirror 1*c* rotates by use of the scanner motor 1 d at high speed to irradiate the image light reflected by the polygonal mirror 1*c* to the rotating photosensitive drum 7 through the focus lens 1*e* and the reflective mirror 1*f*, hence forming the latent image by exposing the surface of the photosensitive drum 7 selectively in accordance with the image information.

(Recording Sheet Conveying Means)

By use of a pickup roller 3*a* arranged on the leading end portion of the recording sheet 2 in cooperation with a separation pad 3*b* pressurized by a pressure spring 3*c*, the conveying means 3 to convey the recording sheet 2 separates the uppermost sheet one by one from the recording sheets 2 which are stacked on a sheet feeding portion D arranged on the upper depths of the image forming portion B (upper right side in FIG. 1) and extended in the direction from the upper to the lower parts, and feeds each sheet thus separated to the conveying roller pair 3*d*. Then, the conveying roller pair 3*d* conveys the recording sheet 2 to the image transferring portion in synchronism with the image forming operation. Thus, after the transfer of image, the recording sheet 2 is guided to fixing means 5 by use of the guiding member 3*e*.

Here, with a multiple slider 3*g* provided for the recording sheet stacking stand 3*f* slidably in the direction at right angles (the widthwise direction of the recording sheet 2) to the conveying direction of the recording sheet 2, it is arranged to support a recording medium of various sizes including the postcard and envelope sizes, not to mention those of fixed sizes, and also, it is arranged thereby to align both sides of the recording sheet 2 stacked on the recording sheet stacking stand 3*f*.

(Transferring Means)

Transferring means 4 transfers to a recording sheet 2 the toner image which is formed on the photosensitive drum 7 in the image forming portion, and as shown in FIG. 1, this means is structured by a transfer roller 4*a* in accordance with the present embodiment. In other words, the recording sheet 2 is pressed by a transfer roller 4*a* to the photosensitive drum 7 of the process cartridge C attached to the image forming portion, and toner on the photosensitive drum 7 is transferred to the recording sheet 2 by applying to the transfer roller 4*a* a voltage having reverse polarity to the toner image which is formed on the photosensitive drum 7.

(Fixing Means)

Fixing means 5 fixes the toner image thus transferred to the recording sheet 2 by the application of the voltage to the transfer roller 4*a*. As shown in FIG. 1, this means comprises a driving roller 5*a* to be driven to rotate; and a fixing member 5*c* provided with a sheet member having an internal heater 5*b* which is pressed to the driving roller 5*a* to rotate following the rotation thereof. In other words, when the recording sheet 2 having the toner image transferred thereto in the image forming portion passes between the driving roller 5*a* and the fixing member 5*c*, pressure is exerted thereon by the pressurized contact of the driving roller 5*a* and the fixing member 5*c*, and also, heating is given by the heater 5*b* in order to fix the toner on the recording sheet 2 to the recording sheet 2.

(Discharging Means)

The recording sheet 2 having the toner images fixed thereon is stacked on a face down tray 6*a* or discharge to the outside of the apparatus in the face-up status.

In the case of face-down sheet discharging, a flapper 6*c* is positioned as shown in FIG. 1 by use of a flapper lever 6*b* so as to reverse the recording sheet 2 by being conveyed by a fixed sheet discharging roller pair 6*d* while guided by the upper face of the flapper 6*c* and a face-down discharging guide 6*e*. Then, by use of a face-down roller pair 6*f*, recording sheets are stacked one after another on the face-down tray 6*a* with the printed surface downward in the order of pages.

In the case of a thick recording medium such as an envelope or a postcard or a special recording medium such as an OHP film or a label seal, there may be encountered a drawback of wrinkles or folding due to the heat curls of a recording medium that becomes greater when reversely conveyed in the aforesaid facedown discharging. In order to avoid this condition, the present embodiment provides a face-up sheet discharging means that keeps a recording medium almost straightly after fixing treatment without reversing it.

In the case of face-up sheet discharging, the flapper 6*c* is switched over by use of the flapper lever 6*b*. Then, the recording sheet 2 is conveyed and guided to the lower face of the flapper 6*c* by the fixed sheet discharging roller pair 6*d*, and discharged to the outside of the apparatus.

(Means for Attaching a Process Cartridge)

Figure 3:
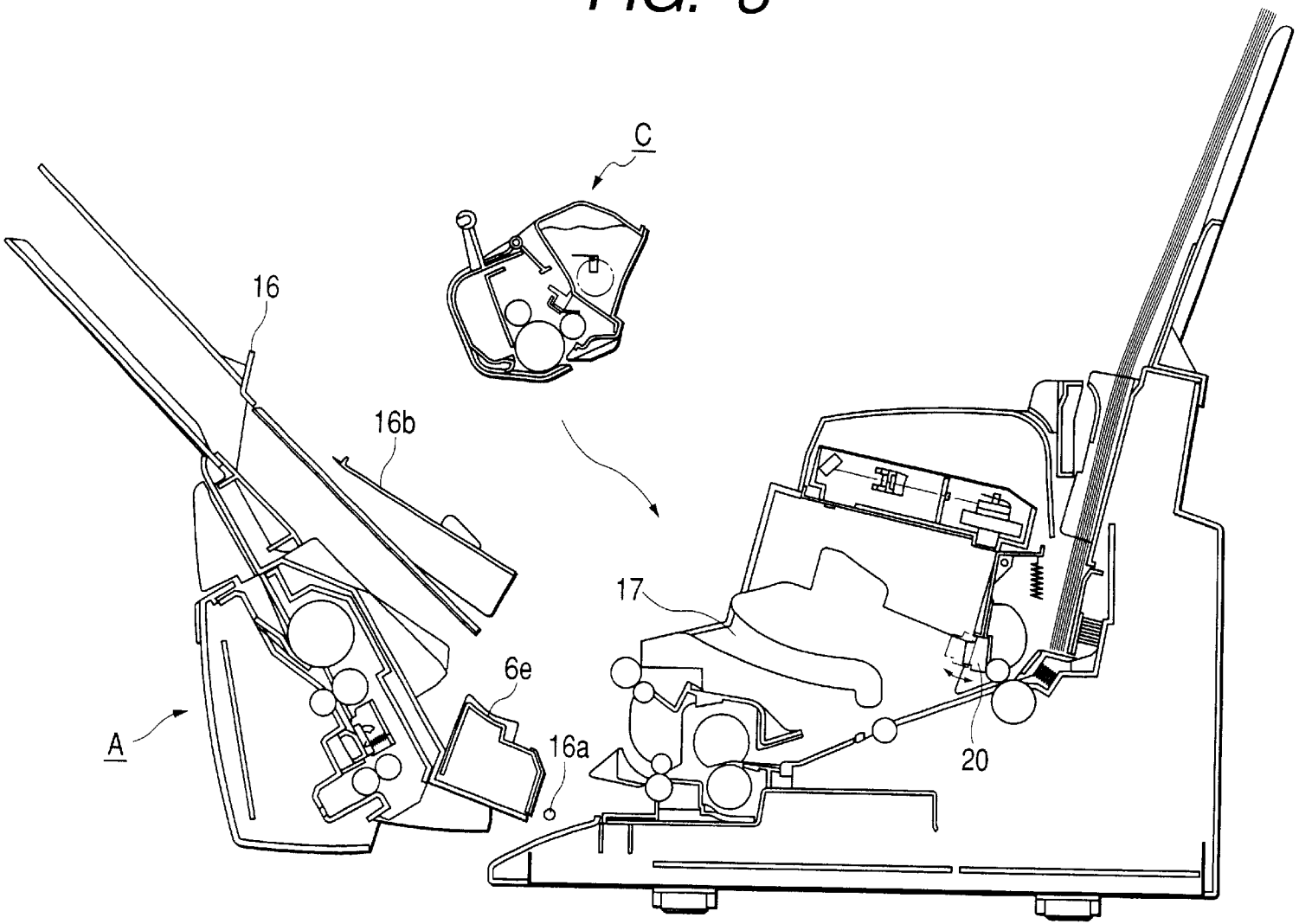
FIG. 3 is a cross-sectional view which shows the status of attaching a process cartridge to or detaching it from the image forming apparatus represented in FIG. 1.

In the image forming portion B, means for attaching a cartridge is arranged to attach the process cartridge C. As shown in FIG. 3, the attachment of the process cartridge C to or detachment thereof from the apparatus main body is carried out from the front face side by opening the open and close cover 16 in the forward direction in front of the apparatus. This cover is integrally formed with the original document reading portion A that includes the original document stacking stand 14*a* and the auxiliary stacking stand 14*b*, as well as with the face-down sheet discharging guide 6*e*; the face-down tray 6*a* for use of face-down sheet discharging; and a heat radiation duct 8 arranged above fixing means 5 and between the image forming portion B and the original document reading portion A so as not to allow the heat which is generated at the time of fixation to exert influence on the image forming portion B and the original document reading portion A.

As shown in FIG. 3, there is arranged a rotation center 16*a* on the lower front side of the apparatus main body, and the structure is arranged so that the open and close cover 16 can rotate in the counterclockwise direction relative to the apparatus main body when a lock portion (not shown) is released by use of a level (not shown), and then, the cover is open in the direction toward the front of the apparatus.

Then, when the aforesaid open and close cover 16 is open, there is arranged a space in the apparatus main body for attaching a cartridge, and also, a guide groove 17 is arranged each for the left and right walls faces of the space. The process cartridge C is inserted with the drum shaft placed along the guide shafts 17. Then, when the open and close cover 16 is closed, the process cartridge C is attached for installation.

Now, the toner sensor (magnetic permeability sensor) 20, which serves as detecting means to detect the remaining amount of developer contained in a developer container, is held by a sensor holder 20*b*. Then, the rotational center 20*c* of the sensor holder 20*b* is axially supported on the main body side. When the open and close cover 16 is closed, the toner sensor 20 swings by connecting means (not shown) in the direction indicated by an arrow in FIG. 3, and by use of a pressurized contact spring 20*d*, the detection head 20*a* of the toner sensor 20 is in contact with the toner chamber 10*a* under a designated pressure. The structure is arranged in this manner so as to be able to detect the presence or absence of toner in the process cartridge C. When the open and close cover 16 is open, the toner sensor 20 is retracted also by connecting means (not shown), thus preventing it from intervening in the attachment or detachment of the process cartridge C.

In this respect, the magnetic permeability sensor 20 is a sensor utilizing the magnetism of developer, and detects the changes of magnetic permeability thereof (which are made interlocked with the quantity of developer becoming larger or smaller in the vicinity of detected portion) as voltage changes so as to grasp the remaining amount of developer in the developer container. In other words, the sensor 20 detects the information corresponding to the magnetic permeability of developer.

The reason why a magnetic permeability sensor 20 is used as the sensor 20 for the present embodiment is that the use of a magnetic permeability sensor is superior to that of an optical sensor in the aspects given below.

1. When an optical sensor is used, at least two members, a light emitting member and a photosensitive member, are needed. Then, for example, from the viewpoint of the strength of a cartridge (developer container) the exterior (outer wall) of which is formed by resin, there is a need for the provision of two windows for use of light transmission at least on two locations on the way of light transmission from the light emitting member to the photosensitive member. As a result, not only the number of components become larger to bring about higher costs, but also, it presents disadvantage in the assembling capability of the cartridge.

2. At least two members should be provided for use of cleaning the aforesaid windows in order to prevent the light transmitting portions of the windows from being stained by toner so as not to allow the detection accuracy to be degraded.

3. It should be structured to rub the window portions with the aforesaid window cleaning members, which tends to damage the surface of each window. As a result, light emitted from the light emitting member is subjected to being dispersed. Once dispersion occurs, the detecting accuracy is degraded.

There are some more problems related to the use of optical sensor, but with the magnetic permeability sensor which is used for the present embodiment, these problems are not encountered.

Now, reverting to the description of the open and close cover, the structure is arranged so that the face-down sheet discharging guide 6*e* can also be released from the main body side, and that the jamming that may take place on the U-turn passage after fixation can be disposed of with ease.

(4) The Structure of the Process Cartridge Detachably Attachable to the Facsimile Apparatus, which Holds a Developer Container Next, the description will be made of the structure of each part of the process cartridge C which is detachably attachable to the aforesaid image forming portion B.

As shown in FIG. 1 to FIG. 4, the process cartridge C is structured to rotate the photosensitive drum 7, which is provided with a photosensitive layer serving as an image bearer, in the direction indicated by an arrow so that the surface thereof is electrostatically charged uniformly by the application of voltage to an electrostatic charging roller 8*a* serving as electrostatic charging means 8, and then, a light image from an optical system 1 is exposed on the photosensitive drum 7 through an exposure opening 9*a* for the formation of the latent image which is developed by use of developing means 10.

This developing means 10 supplies to a developing chamber 10*b* the magnetic toner which is magnetic developer in a toner chamber 10*a* serving as a developer container, and rotates a developing roller 10*c* installed in the developing chamber 10*b*, and at the same time, forms the toner layer, which is provided with fictionally electrostatic charge by a developing blade 10*d*, on the surface of the developing roller 10*c* having a fixed magnet incorporated therein. Then, the toner is transferred to the photosensitive drum 7 in accordance with the aforesaid latent image to form the toner image for visualization. At this juncture, an agitating rod 10*e* serving as agitating means is connected with the developing roller 10*c* by use of a gear (not shown) to rotate in the direction indicated by an arrow for agitating toner. Therefore, toner is supplied from the interior of the toner chamber 10*a* to the developing chamber lob without being stagnated. As the material of the agitating rod 10*e*, a metallic shaft (magnetic member) is used.

Then, the structure is arranged so that the residual toner on the photosensitive drum 7 is removed by cleaning means 11 in such a manner that subsequent to having transferred the toner image to a recording sheet 2 by the application of voltage having the reverse polarity to the aforesaid toner image to the transfer roller 4*a*, the residual toner on the photosensitive drum 7 is scraped off by use of a cleaning blade 11*a* and collected to a waste toner pool 11*b*.

Each component of the photosensitive drum 7 and others is housed in the process cartridge C which is structured by combining a toner development frame member 12*a*, a development wall member 12*b*, and a cleaning frame member 12*c* together in a cartridge form. In other words, the toner development frame member 12*a* and the development wall member 12*b* are welded to from the toner chamber 10*a* and the developing chamber 10*b*, and then, the developing roller 10*c* and the developing blade 10*d* are installed on the developing chamber 10*b*.

Also, there are installed on the cleaning frame member 12*c*, the photosensitive drum 7 and the electrostatic charging roller 8*a*, as well as each member that constitutes cleaning means 11. Then, the cleaning frame member 12*c* is coupled with the aforesaid toner development frame member 12*a* to form the process cartridge C.

For the process cartridge C, a exposure opening 9*a* for effectuating the image exposure, and a transfer opening 9*b* for enabling the photosensitive drum 7 to face a recording sheet 2 are provided, and also, a shutter member 9*c* is installed to make the opening of both exposure opening 9*a* and transfer opening 9*b* possible.

Also, for the portion of the development wall member 12*b* where the toner sensor 20 (toner amount detecting sensor) is in contact in order to detect the presence or absence of toner in an amount less than a designated amount in the toner chamber 10*a* (hereinafter referred to simply as the presence or absence of toner), the recess $\mathbf{12}b_1$, which is made locally thinner for use of sensor contact, is arranged on the outer side of the toner chamber 10*a* in order to enhance the detection accuracy by allowing the toner sensor 20 to be placed closer to toner, thus preventing the degree of reduction from being biased when toner is reduced following the consumption thereof. With the structure thus arranged, it becomes possible to detect the presence or absence of toner reliably.

Further, a scrape-off sheet 10*f* is provided for the toner presence or absence detecting portion of the agitating rod 10*e*. The scrape-off sheet 10*f* rubs the toner presence or absence detecting portion on the inner wall of the toner chamber 10*a*. Thus, it is arranged that even when toner is reduced by consumption, toner can be supplied to the developing chamber 10*b* reliably without being stagnated on the toner presence or absence detecting portion.

The scrape-off sheet 10*f* is provided above the rotation circle of the agitating rod 10*e* to be tangential thereto, and also, made escapable when the scrape-off sheet 10*f* operates scraping off against the inner wall of the toner chamber 10*a*. This sheet exerts only an extremely small pressure good enough to scrape off toner If the toner is stagnated on the toner presence and absence portion. This is because the quality of toner should not be allowed to change by the pressure to be exerted thereon. Therefore, it is arranged to make the thickness of the scrape-off sheet 10*f* approximately 0.05 mm with a large hole extracted from the center thereof to minimize the firmness of the scape-off sheet 10*f*. In this manner, no excessive pressure is exerted on toner.

Figure 4:
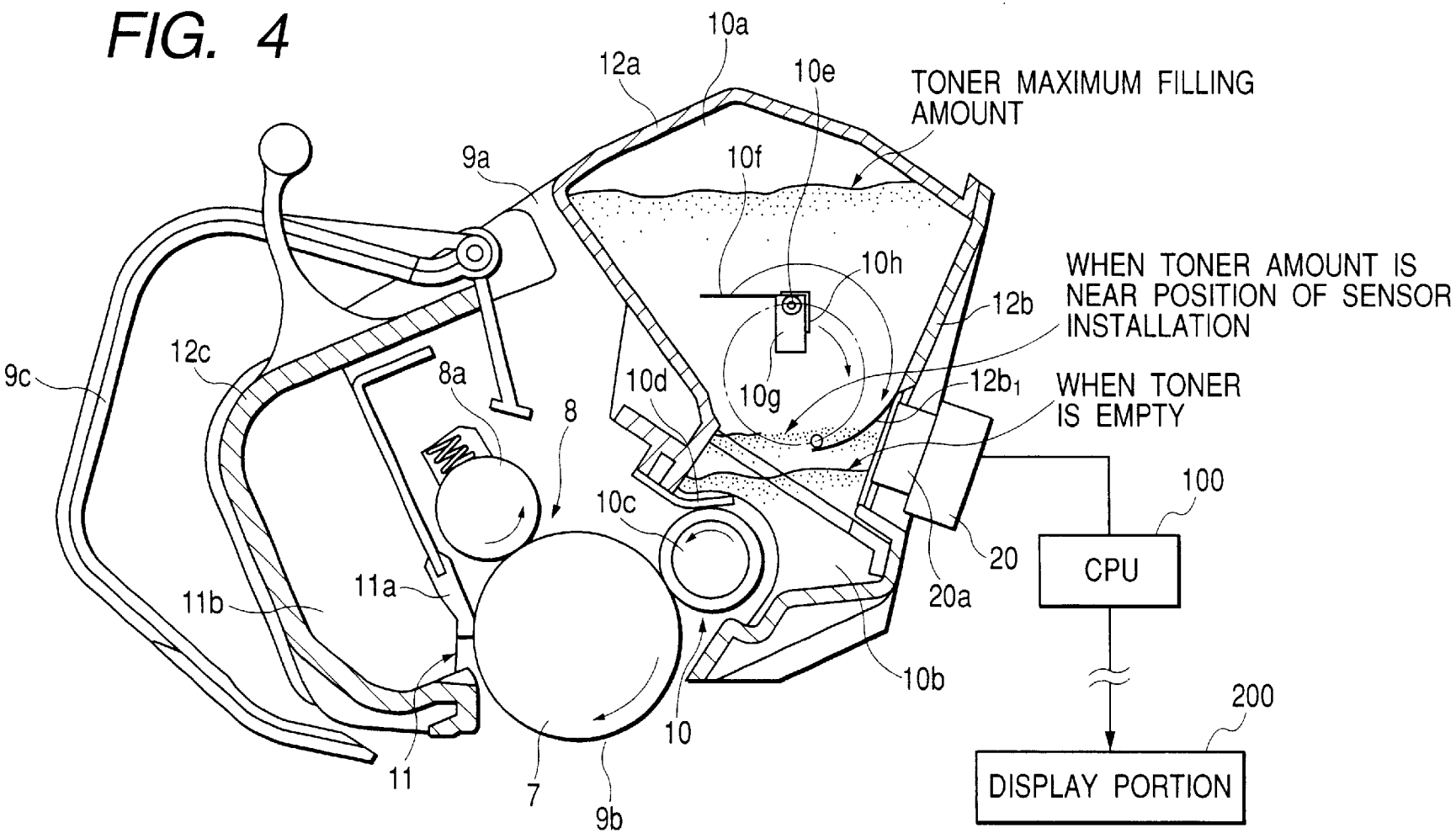
FIG. 4 is a cross-sectional view which shows schematically the structure of the process cartridge provided for the image forming apparatus represented in FIG. 1.

(5) The Structure of the Device of the Present Invention for Determining the Status of a Developer Container In accordance with the present embodiment, the device for determining the status of a developer container detects the presence or absence of toner in a toner chamber 10*a* by use of a toner sensor 20. Then, as shown in FIG. 4, the toner sensor 20 is arranged in the main body to enable the detection head 20*a* thereof to face the recess $12b_1$ of a development wall member 12*b* near the bottom of the toner chamber 10*a*, and fixed in a state where the toner absence can be detected when the toner chamber 10*a* becomes almost empty.

FIGS. 5A to 5F are views which show the relationships between toner remaining in the toner chamber 10*a* and the analog output signals of the toner sensor 20.

Figures 5A, 5B, 5C, 5D:
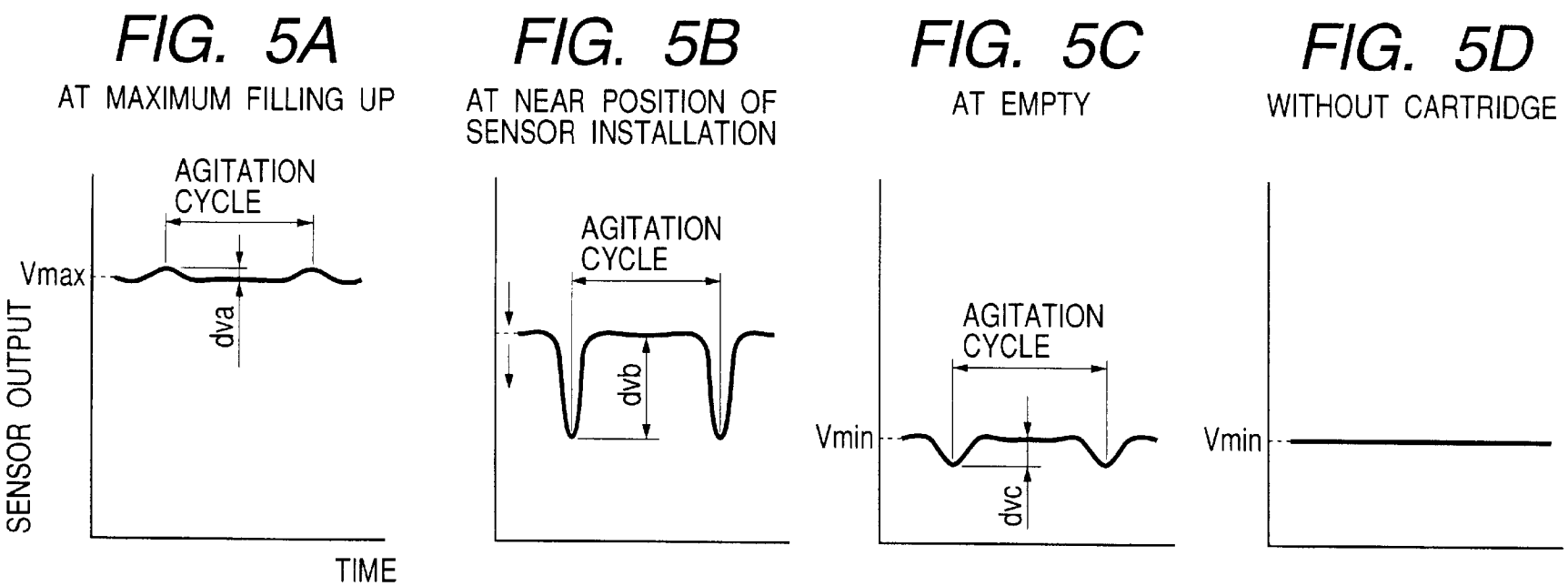
FIGS. 5A, 5B, 5C and 5D are views which illustrate the output values of detecting means provided for the image forming apparatus represented in FIG. 1.

When the toner remaining in the toner chamber 10*a* is at maximum filling up as shown in FIG. 5A, the output of the toner sensor 20 indicates the highest output voltage ($V_{max}$), and a minute rise of output voltage (dVa) is generated by an agitation cycle by the influence of agitating operation of the agitating rod 10*e* (at the timing of the agitating rod 10*e* (magnetic member) which passes near the detection portion). After that, the status shown in FIG. 5A is kept for a while even if the toner consumption advances.

When the toner remaining in the toner chamber 10*a* is located near the position where the toner sensor 20 is installed as shown in FIG. 5B (at the detecting portion), the output voltage of the toner sensor 20 drops greatly (dVd) by the agitation cycle of the agitating rod 10*e* due to the influence exerted by the scrape-off sheet 10*f* that scrapes off the toner near the detecting portion by the agitating rod 10*e*, and then, the value of output voltage is reduced gradually.

When the toner remaining in the toner chamber 10*a* is emptied (less than a designated amount) as shown FIG. 5C, the output of the toner sensor 20 indicates the lower output voltage ($V_{min}$), and the magnetic permeability of the agitating rod 10*e* is detected as a metallic material. Therefore, a slight drop of output voltage (dVc) is generated by the agitating cycle.

On the other hand, when the cartridge is absent (in the state of being detached) as shown in FIG. 5D, the output of the toner sensor 20 is not affected by magnetism at all, and the lowest output voltage ($V_{min}$) is indicated. Also, there is no influence exerted by the agitating operation at all so as not to generate any output changes.

From the values of output voltage of the toner sensor 20 as described above, it is arranged to determine the presence or absence of toner in the toner chamber 10*a* in an amount more than a designated amount (the presence or absence of toner), and the status of the process cartridge C attached to or detached from the image forming portion B (the presence or absence of a cartridge). Now, the way of such determination will be described.

Figure 6:
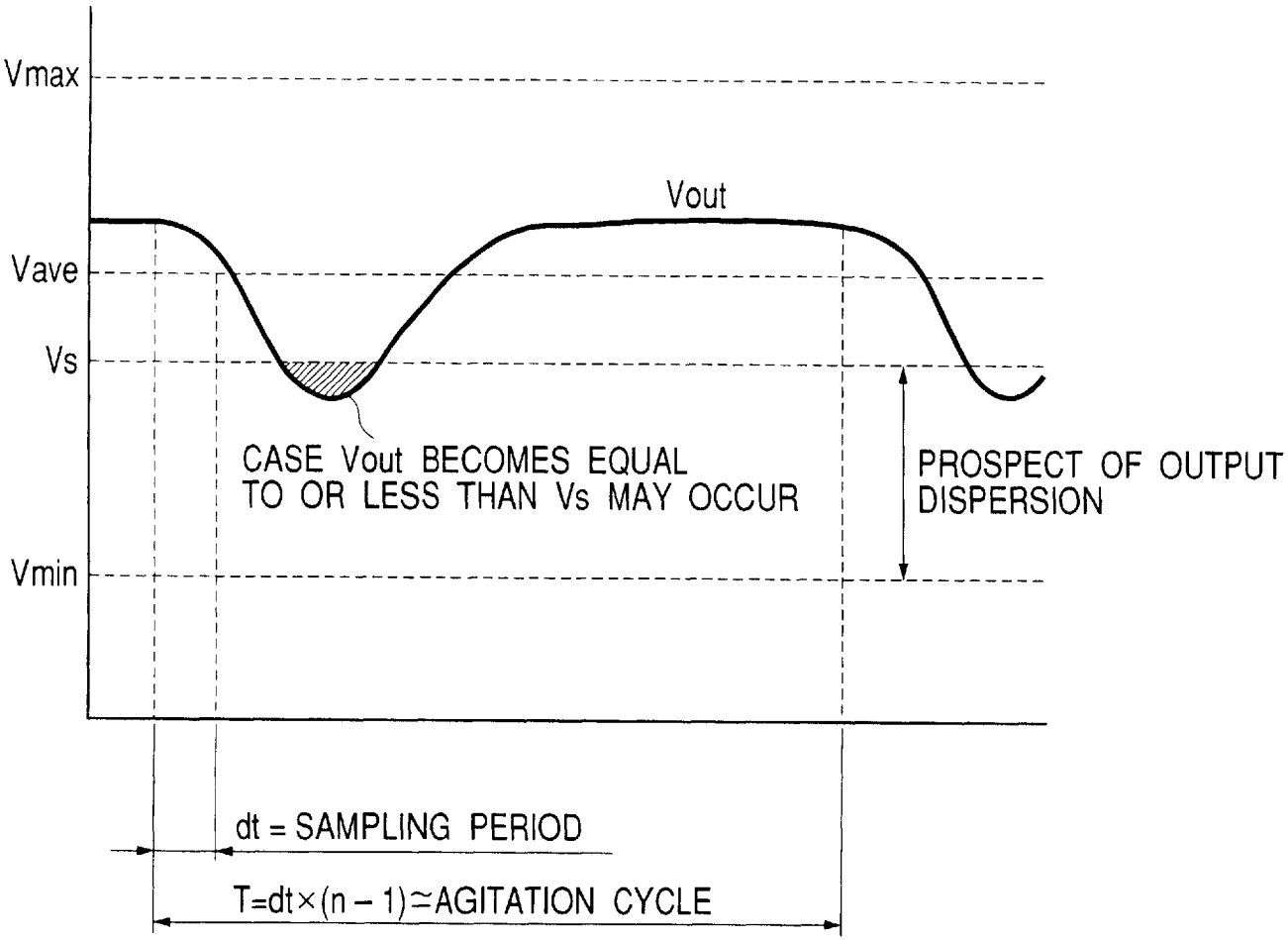
FIG. 6 is a view which illustrates the determination of whether or not developer is present inside a developer container in accordance with the output values of detecting means.

With reference to FIG. 6, a description will be made of determining the presence or absence of toner.

As shown in FIG. 6, the toner sensor 20 is subjected to the fluctuation of output of the sensor itself, the fluctuation of the supply-source voltage from the main body side of an image forming apparatus, the fluctuation of magnetism of toner itself, or the like. As a result, the sensor output value ($V_{out}$) varies when toner is absent. For that matter, the threshold value (slice level=Vs), which is the value to be set at determining the absence of toner, should be defined in anticipation of such fluctuating value.

However, the toner remaining in the toner chamber 10*a* reduces the values of output voltage gradually, while causing the output voltage of the toner sensor 20 to change greatly by the rotational cycle of the agitating rod 10*e* near at the installation position of the toner sensor 20 due to the influence exerted by the scrape-off sheet 10*f*. Therefore, if it is determined that no toner is present when the sensor output becomes less than the Vs at a certain timing, there may be some cases where the toner absence is determined eventually despite the fact that the residual toner is still near at the installation position of the toner sensor 20 with the result that toner absence is not adequately recognized.

Now, therefore, in accordance with the present embodiment, it is arranged that a first determining means (CPU 100 in FIG. 1 (control device)) works out the output voltage of the toner sensor 20 as an average value ($V_{ave}$) at a specifically calculation cycle (T)=a specific number of samples (n), and than, a second determining means (CPU 100) makes the toner absence determination for the first time when the $V_{ave}$ becomes smaller than the Vs.

Further, in accordance with the present embodiment, the interval (dt) is set at 0.16 (sec) for the CPU 100 to sample the output voltage of the toner sensor 20. Then, the calculation cycle (T) at which the average value ($V_{ave}$) is worked out is made almost equal to the rotational cycle= approximately 4.3 (sec) of the scrape-off sheet 10*f*. Thus, the average value is worked out for the sampling number of n=28 times, that is, T=0.16 (sec)×(28−1)=approximately 4.3 (sec). The behavior of output fluctuation due to the influence of scrape-off sheet 10*f* is comparatively stable, and it is ascertained by experiments that even when the output changes occur, the $V_{ave}$ indicates almost no fluctuation at intervals of the cycle T. Thus, it is made possible for the first time to perform the detection of toner presence or absence adequately when the $V_{ave}$ becomes smaller than the Vs.

As regards the detection of the status of attachment or detachment of the process cartridge C with respect to the image forming portion B (hereinafter simply referred to as the presence or absence of cartridge), it should be good enough if only the case of toner absence can be examined, because the cartridge should be present as a matter of course if the toner presence is ascertained in the aforesaid process of toner presence or absence determination.

Figure 7:
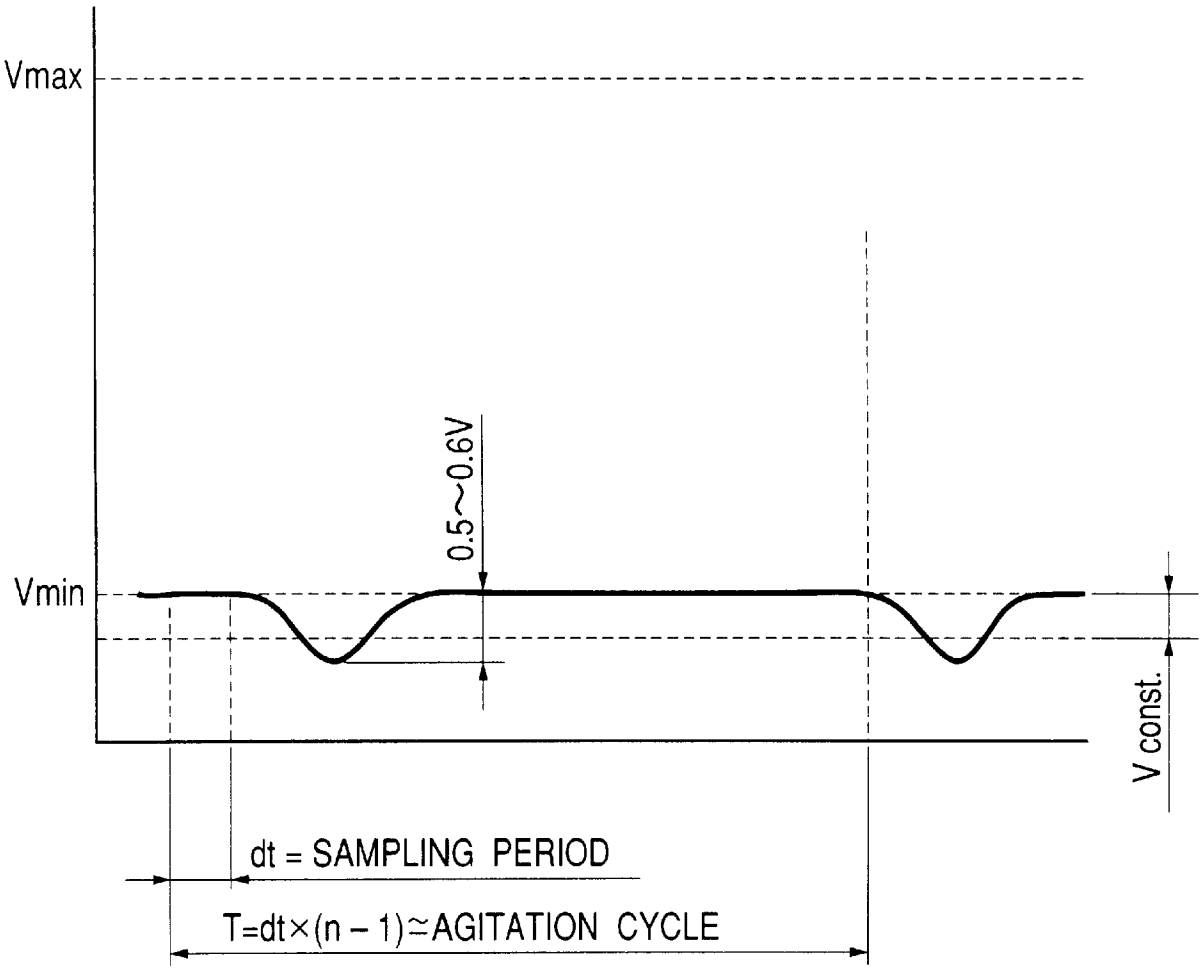
FIG. 7 is a view which illustrates the determination of the status of attachment or detachment of the developer container in accordance with the output values of detecting means.

In accordance with the present embodiment, a third determining means (CPU 100) compares the maximum value and the minimum value of the output values of n times of the aforesaid sampling period (dt) as shown in FIG. 7, and if the difference is found to be less than a constant value of voltage ($V_{const}$), the second determining means determines that there is no cartridge. With no cartridge (when the process cartridge C is detached from the image forming portion B), the output does not change at all. Also, the output fluctuation due to the influence of the agitating rod 10*e* is extremely stable when only the toner no longer exists, which is experimentally ascertained to be 0.5 to 0.6 (V) approximately. Therefore, it should be good enough if only the state of only the toner being absent, and the state of no cartridge can be discriminated reliably. With the sampling period (dt) being set appropriately, it becomes possible to detect the presence or absence of a cartridge reliably in accordance with the stabilized value ($V_{const}$) For the present embodiment, the detection of cartridge presence or absence is made exactly by setting the dt=0.16 (sec), and the $V_{const}$= 0.4 (V).

Figure 8:
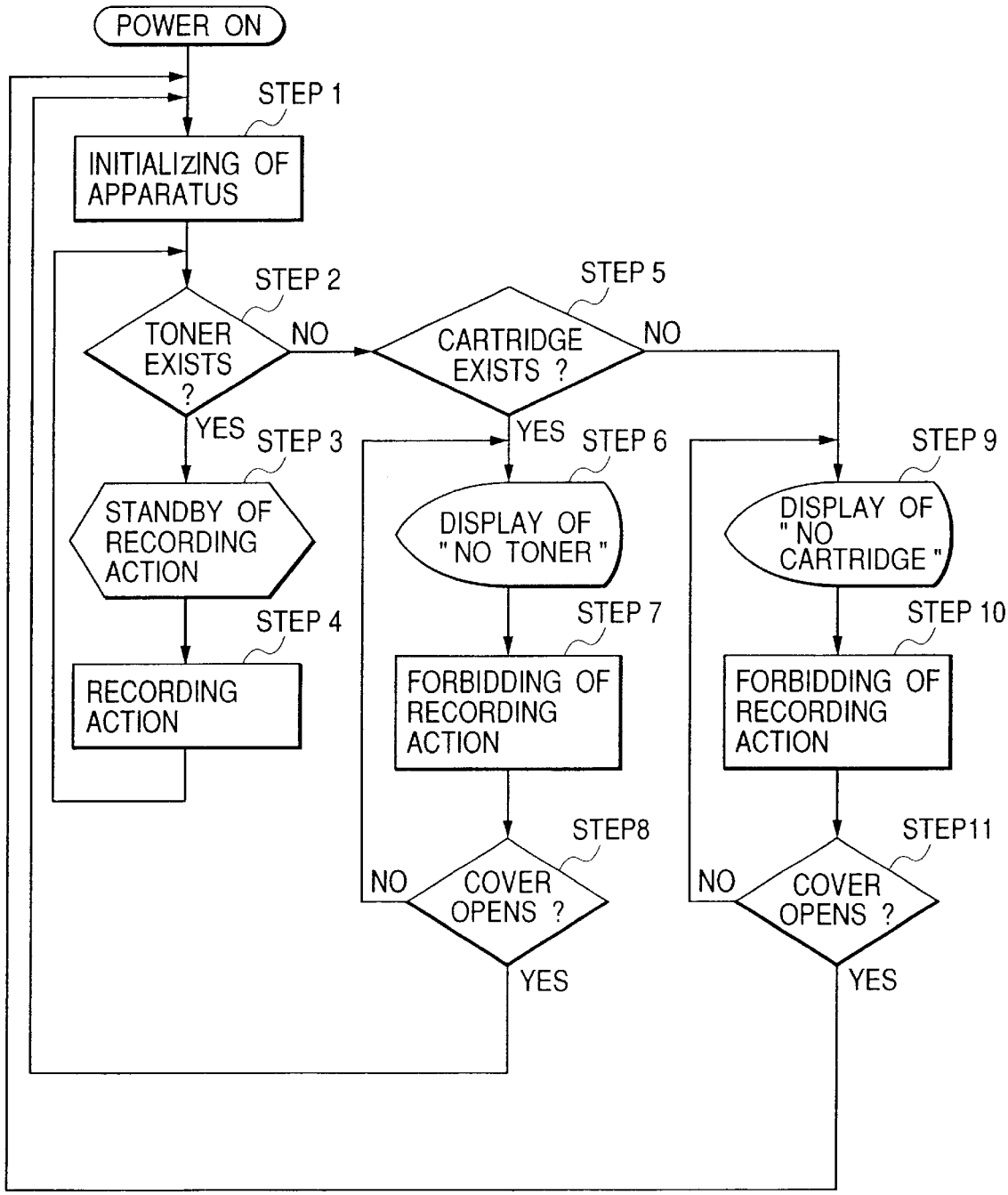
FIG. 8 is a flowchart which shows the presence or absence of developer inside the developer container, as well as the status of attachment or detachment of the developer container in accordance with the embodiment of the present invention.

With the result thus obtainable in view as to the presence or absence of toner, and those of cartridge as well, the facsimile apparatus of the present embodiment determines the presence or absence of toner and cartridge in accordance with the flowchart shown in FIG. 8.

For a facsimile apparatus of the kind, the apparatus is initialized when turning it on including the operation of the agitating rod 10*e* for a specific period of time at first (step 1). Then, the second determining means determines the presence or absence of toner (step 2). If toner exists, the recording operation (image forming operation) is on standby (step 3). Next, the recording operation beings (step 4). On the other hand, if no toner is found, the second determining means determines in continuation whether or not the cartridge is present (step 5). If the cartridge exists, the second determining means determines that there is no toner. The indication "no toner" is then displayed on an operation panel 200 (liquid crystal display) (step 6). Thus, the recording operation is prohibited (step 7). Then, the opening and closing of the cover is examined. When the cover is opened and closed, the apparatus is initialized with the completion of the attachment of cartridge (step 1). If no cartridge is present, it is determined accordingly, and the indication "no cartridge" is displayed on the operation panel (step 9). Then, the recording operation is prohibited (step 10). The state of the open and close cover is examined (step 11), and when the cover is open and closed, the apparatus is initialized with the completion of the attachment of cartridge (step 1). In this manner, the presence or absence of toner and cartridge is determined exactly, and should there be any errors, the contents thereof are notified to the user so as to enable him to understand the required process of disposition with ease.

Therefore, in accordance with the present embodiment, there is no need for the separate provision of a sensor for detecting the status of the attachment or detachment of the process cartridge C that includes the toner chamber 10*a* serving as a developer container. With the toner sensor 10*a* that detects the amount of toner in the toner chamber 10*a*, it is possible to determine the presence or absence of toner in the toner chamber 10*a* in an amount more than a designated amount, and the status of attachment or detachment of the process cartridge C as well, hence making it possible to prevent the apparatus main body from being damaged by a malfunction without impairing the operativity of the apparatus, while implementing cost reduction and making the apparatus smaller.

In this respect, besides the apparatus described in accordance with the present embodiment, the image forming apparatus of the present invention may be a facsimile apparatus to which an extended telephone set is connectable or the one which includes an extended telephone set. Also, the present invention is of course applicable to a copying machine, a printer, or a multi-functional printer other than the facsimile apparatus. Further, the present invention is applicable to the apparatus connectable to a computer or network, which is provided with a connector for connection or a separate unit for use of connection. In this case, the CPU outputs signals to the computer or the like at the connected party in order to display the error indication as to the presence or absence of toner or cartridge (developer container).

What is claimed is:

1. A method for determining whether a developer container for containing developer is attached to an image forming apparatus using detecting means for outputting information pertaining to a magnetic permeability of the developer so as to detect a remaining amount of the developer in the developer container, the developer container including an agitating member provided with a magnetic member for agitating the developer in the developer container, and the developer container being detachably attachable to the image forming apparatus, said method comprising the steps of:

detecting a plurality of sampling values, which are obtained by sampling an output of the detecting means at a predetermined timing in a period substantially corresponding to an agitating cycle of the agitating member; and determining whether the developer container is attached to the image forming apparatus in accordance with the plurality of sampling values obtained in said detecting step.

2. The method according to claim 2, wherein a determination in said determining step is made as to whether the developer container is attached to the image forming apparatus if the difference is outside of a designated range.

3. A method according to claim 2, wherein in said determining step determines that the developer container is attached to the image forming apparatus if the difference is outside of a designated range and that the developer container is not attached to the image forming apparatus if the difference is within a designated range.

4. A method according to claim 3, wherein in said determining step the first sampling value and the second sampling value correspond to a maximum sampling value and a minimum sampling value, respectively.

5. The method according to claim 1, further comprising a step of:

indicating a result of a determination on a display provided by the image forming apparatus.

6. The method according to claim 1, wherein detecting means is arranged so as to abut against an outer wall of the developer container, and the magnetic member moves in a vicninty of a detecting portion of an inner wall of the developer container.

7. An image forming apparatus comprising:

a developer container for containing magnetic developer, said developer container being detachably attachable to said image forming apparatus;

an agitating member provided with a magnetic member for agitating the developer in said developer container;

detecting means for outputting information pertaining to a magnetic permeability of the developer so as to detect a remaining amount of the developer in said developer container; and determining means for determining whether said developer container is attached to said image forming apparatus, based on a plurality of sampling values, which are obtained by sampling an output of said detecting means at a predetermined timing in a period substantially corresponding to an agitating cycle of said agitating member.

8. The apparatus according to claim 7, wherein said determining means determines that said developer container is attached to said image forming apparatus, based on a difference between a first sampling value and a second sampling value, which are obtained by sampling the output of said detecting means at the predetermined timing in the period.

9. An image forming apparatus according to claim 8, wherein said determining means determines that said developer container is attached to said image forming apparatus if the difference is outside of a designated range and the developer container is not attached to said image forming apparatus if the difference is within a designated range.

10. An image forming apparatus according to claim 9, wherein the first sampling value and the second sampling value correspond to a maximum sampling value and a minimum sampling value, respectively, and are obtained by sampling the output of said detecting means.

11. The apparatus according to claim 7, further comprising:

display means for indicating a result of a determination made by said determining means.

12. An image forming apparatus according to claim 7, wherein said detecting means is disposed so as to abut against an outer wall of said developer container, and said magnetic member moves in a vicinity of detecting portion of an inner wall of said developer container.

13. An image forming apparatus according to claim 12, wherein a leading end of said agitating member is provided with a scrapping member for scrapping developer adhering to said detection portion.

14. An image forming apparatus according to claim 7, wherein said detecting means is provided at an attaching portion for detachably attaching said developer container to said image forming apparatus.

15. An image forming apparatus comprising:

a developer container for containing magnetic developer, said developer container being detachably attachable to said image forming apparatus;

an agitating member provided with a magnetic member for agitating the developer in said developer container;

a magnetic sensor for detecting a remaining amount of the developer in said developer container; and determining means for determining whether said developer container is attached to said image forming apparatus in accordance with whether said magnetic sensor is outputting an output pertaining to an agitating action of said agitating member.

* * * * *

UNITED STATES PATENT AND TRADEMARK OFFICE

CERTIFICATE OF CORRECTION

PATENT NO. : 6,763,198 B2
DATED : July 13, 2004
INVENTOR(S) : Yasuhiro Matsumoto It is certified that error appears in the above-identified patent and that said Letters Patent is hereby corrected as shown below:

Column 1,
Line 42, “fo” should read -- of --.

Column 2,
Line 13, “microswitch.” should read -- microswitch --.

Column 4,
Line 61, “1 d” should read -- 1d --.

Column 7,
Line 41, “which” should read -- Which --.

Column 8,
Line 31, “a” should read -- an --;
Line 43, “$12b_1$” should read -- 12b1, --; and
Line 65, “If” should read -- if --.

Column 9,
Line 4, “scape-off” should read -- scrape-off --; and
Line 13, “$12b_1$” should read -- 12b1 --.

Column 10,
Line 62, “($V_{const}$)” should read -- ($V_{const}$). --.

Column 11,
Line 10, “beings” should read -- begins --.

Column 12,
Line 14, “The” should read -- A --; and “claim 2,” should read -- claim 1, --;
Line 17, “ratus if the difference is outside of a designated range.” should read -- ratus, based on a difference between a first sampling value and a second sampling value, which are obtained in said detecting step, --;

UNITED STATES PATENT AND TRADEMARK OFFICE

CERTIFICATE OF CORRECTION

PATENT NO. : 6,763,198 B2
DATED : July 13, 2004
INVENTOR(S) : Yasuhiro Matsumoto It is certified that error appears in the above-identified patent and that said Letters Patent is hereby corrected as shown below:

Column 12, cont'd.,
Line 18, "A" should read -- The --;
Line 32, "wherein" should read -- wherein the --;
Line 55, "The apparatus" should read -- An image forming apparatus --;
Line 56, "that" should read -- whether --; and
Line 62, "An image forming apparatus" should read -- The apparatus --.

Signed and Sealed this

Twenty-sixth Day of October, 2004

JON W. DUDAS
*Director of the United States Patent and Trademark Office*